United States Patent [19]

Yagi

[11] Patent Number: 4,574,411

[45] Date of Patent: Mar. 11, 1986

[54] PILLOW

[75] Inventor: Toshizo Yagi, Kodairashi, Japan

[73] Assignee: Japan Life Co. Ltd., Tokyo, Japan

[21] Appl. No.: 540,909

[22] Filed: Oct. 12, 1983

[51] Int. Cl.[4] ..... A47C 20/02

[52] U.S. Cl. ..... 5/434; 5/447; 5/440; 5/442

[58] Field of Search ..... 5/434, 435, 436, 437, 5/442, 447, 462, 481, 446, 464

[56] References Cited

U.S. PATENT DOCUMENTS

| | | | |
|---|---|---|---|
| 2,234,506 | 3/1941 | Sistig | 5/436 |
| 2,880,428 | 4/1959 | Forsland | 5/436 |
| 3,242,511 | 3/1966 | Fultz et al. | 5/435 |
| 3,487,134 | 12/1969 | Burr | 5/434 |
| 4,143,435 | 8/1977 | Masuda | 5/481 |
| 4,161,045 | 7/1979 | Regan | 5/447 |
| 4,320,543 | 3/1982 | Dixon | 5/434 |

FOREIGN PATENT DOCUMENTS

| | | | |
|---|---|---|---|
| 999217 | 7/1965 | United Kingdom | 5/434 |

*Primary Examiner*—Kenneth J. Dorner
*Assistant Examiner*—Michael F. Trettel
*Attorney, Agent, or Firm*—Browdy and Neimark

[57] ABSTRACT

An improved pillow is provided by inserting cushion material fixed with a plurality of porcelain tiles on its surface, into a bag body having permeability and elasticity. Its shape is held during use, and natural sleeping posture is maintained, and the porcelain tile cools the head moderately for comfortable sleep.

7 Claims, 2 Drawing Figures

PILLOW

BACKGROUND OF THE INVENTION

1. Field of the Invention

The present invention relates to an improved pillow for effecting pleasant sleeping.

2. Description of the Prior Art

Sleeping is indispensably important for overcoming fatigue or tiredness. For sound sleep, not only bedding but also the pillow has a great influence. "Keeping the head cool and the feet warm" has been said to be a first condition for obtaining comfortable sleep. This is correct from the scientific view, too. Thus, medical data reports that the mind is relaxed and a person may go into a state of natural sleeping by lowering the temperature of the pillow by about 5° to 10° C. lower than the temperature of the back of the head (around 35° C.). Further the size and height of the pillow is closely related to peaceful sleep. Thus, a difference of more than 20 minutes arises until deep sleep occurs between the pillows suitable and not suitable for sound sleep. Differences also occur in awareness at the time of waking up. Although a pillow gives a large influence to one's sleep, an ideal pillow has not appeared so far.

SUMMARY OF THE INVENTION

A main object of the invention is to provide a pillow with which sleep is naturally obtained.

Another object of the invention is to provide a pillow which absorbs heat and reduces the temperature at the back of the head, so that the condition of "keeping the head cool and the feet warm" is maintained during sleeping.

A further object of the invention is to provide a pillow which has the most suitable height and hardness to provide peaceful sleep, so that ideal sleeping posture may be obtained.

Other objects and advantages to be brought about by the invention will be apparent from description of the invention with reference to the drawing.

DETAILED DESCRIPTION OF THE INVENTION

Figure 1:
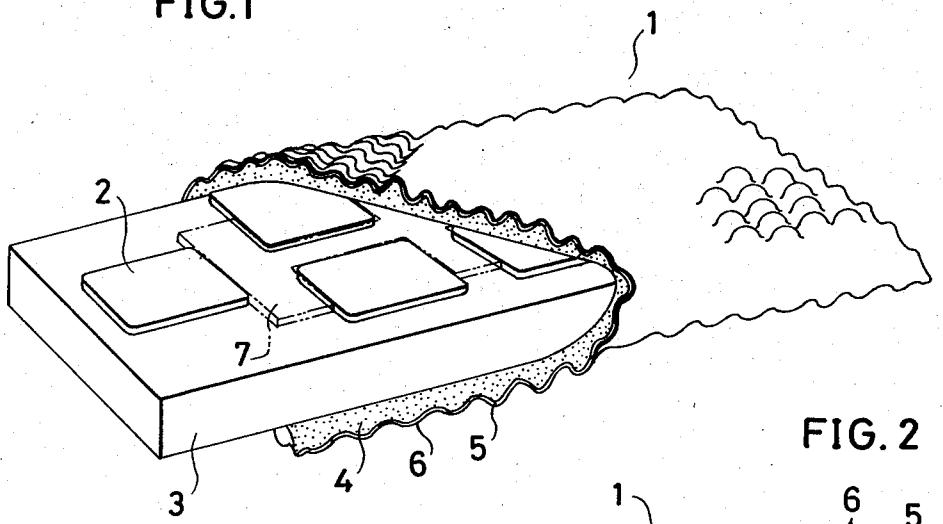
FIG. 1 is a perspective view, partially in section, showing a pillow according to the invention, taking out stuffed material.
Figure 2:
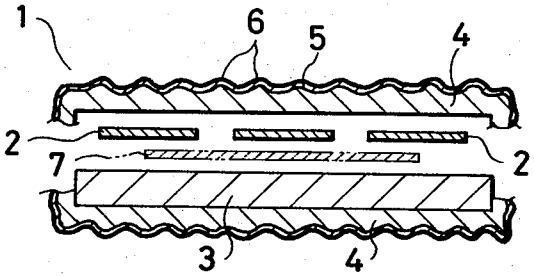
FIG. 2 is a vertical cross sectional view showing inner structure.

An improved pillow according to the invention is obtained by inserting cushion material 3 having porcelain tiles on its surface into a bag body 1 made of urethane foam. The bag body 1 is made of the cushion material, preferably urethane foam, where wave-like projections 5 are formed regularly lengthwise and crosswise on the urethane form 4 of about 150 mm in thickness, and resin liquid such as liquid of urethane foam is impregnated thereon to form said bag of a hard outer cover 6.

For the cushion material, thick urethane foam is in general employed, on a surface of which six, e.g., flat porcelain tiles 2 are fixed with adhesives, and at least one spacer 7 is preferably arranged to stop movement of the tiles.

For the spacer 7, at least one plastic plate may be used which runs lengthwise and crosswise in the spaces between the porcelain tiles 2, otherwise urethane foam pieces may be used which are hardened by impregnating same with resin liquid. Such one or more spacers 7 are fixedly positioned on determined parts of the cushion material 3, and subsequently the porcelain tiles 2 are attached to the cushion material 3, or after having attached the porcelain tiles 2, the one or more spacers 7 are positioned in place at the spaces between the tiles 2. The cushion material 3 having the tiles 2 is inserted into the bag body 1 and the bag body 1 is closed at its mouth. In use, the bag body 1 is protected with a suitable clothcover.

The pillow according to the invention has the above said structure, and many advantages as follows.

(1) It provides a natural sleeping posture thereby inducing peaceful sleep

The combination of the concaves and convexes (wavelike projection) and the porcelain tiles, keeps the shape of the pillow stable. Therefore the pillow moves little as do conventional pillows so that comfortable sleep may be obtained all night long.

(2) It provide a good height for natural sleeping posture

Conventional pillows are often too high, thereby causing, muscles at the neck or the shoulders to become stretched with the result of stiffness occurring there. If a pillow is too low, conversely, the neck is tense and sleep is insufficient to eliminate fatigue. The pillow of the invention makes the mind relaxed and is about 8 cm in height.

(3) It keeps the head cool with the porcelain tiles.

(4) It is by hygienic air permeability and evaporation

The permeable material such as the urethane foam is used and formed with concaves and convexes due to the wave like projections. The shape is held and the permeability is maintained.

What is claimed is:

1. An improved pillow, comprising a core formed of cushion material having attached to its surface a plurality of ceramic tiles, said core being inserted into a hollow body having permeability and elasticity, said hollow body being formed of a flexible plastic foam the outer surface of which is harder than the remainder of said flexible foam, said ceramic tiles being maintained in position on the surface of said core via at least one spacer comprising a plate having a shape corresponding to at least one space between the ceramic tiles, said at least one spacer being located on said core between adjacent ceramic tiles.

2. A pillow as claimed in claim 1, wherein said foam plastic of said hollow body is of urethane foam.

3. A pillow according to claim 2, wherein said urethane foam hollow body has wave-like projections formed regularly lengthwise and cross-wise thereon.

4. A pillow as claimed in claim 3, wherein said hollow body is provided with its said harder outer surface by impregnating said urethane foam with a resin liquid.

5. A pillow as claimed in claim 1, wherein the care comprises thick urethane foam.

6. A pillow according to claim 1 wherein said at least one spacer plate is formed of plastic.

7. A pillow as claimed in claim 6, wherein said at least one plastic spacer plate is of urethane foam hardened by impregnation with resin liquid.

* * * * *